US006751331B2

(12) United States Patent
Eisenbraun

(10) Patent No.: US 6,751,331 B2
(45) Date of Patent: Jun. 15, 2004

(54) COMMUNICATION HEADSET

(75) Inventor: Kenneth D. Eisenbraun, Bloomfield Village, MI (US)

(73) Assignee: United Global Sourcing Incorporated, Troy, MI (US)

( * ) Notice: Subject to any disclaimer, the term of this patent is extended or adjusted under 35 U.S.C. 154(b) by 0 days.

(21) Appl. No.: 10/268,580

(22) Filed: Oct. 10, 2002

(65) Prior Publication Data

US 2003/0072466 A1 Apr. 17, 2003

Related U.S. Application Data

(60) Provisional application No. 60/328,547, filed on Oct. 11, 2001.

(51) Int. Cl.[7] ..... H04R 25/00

(52) U.S. Cl. ..... 381/375; 381/370; 381/381

(58) Field of Search ..... 381/370, 374, 381/375, 376, 381, 327, 328, 378, 379, 382; 379/430; 181/20, 21, 128

(56) References Cited

U.S. PATENT DOCUMENTS

| | | | | |
|---|---|---|---|---|
| 4,039,765 A | | 8/1977 | Tichy et al. | 179/156 A |
| 4,335,281 A | | 6/1982 | Scott et al. | 179/156 A |
| 4,893,344 A | | 1/1990 | Tragardh et al. | 381/187 |
| 4,917,504 A | | 4/1990 | Scott et al. | 381/187 |
| 4,987,592 A | * | 1/1991 | Flagg | 379/430 |
| D344,730 S | | 3/1994 | Gattey et al. | D14/206 |
| 5,381,486 A | | 1/1995 | Ludeke et al. | 381/187 |
| 5,446,788 A | | 8/1995 | Lucey et al. | 379/430 |
| D375,313 S | | 11/1996 | Jensen et al. | D14/205 |
| D377,020 S | | 12/1996 | Bungardt et al. | D14/205 |
| 5,761,298 A | | 6/1998 | Davis et al. | 379/430 |
| 5,787,166 A | | 7/1998 | Ullman | 379/430 |
| D403,327 S | | 12/1998 | Landreth et al. | D14/223 |
| 6,101,260 A | | 8/2000 | Jensen et al. | 381/381 |
| D436,348 S | | 1/2001 | McGugan | D14/142 |
| D439,890 S | | 4/2001 | Skulley et al. | D14/223 |

* cited by examiner

*Primary Examiner*—Huyen Le
(74) *Attorney, Agent, or Firm*—Gifford, Krass, Groh, Sprinkle, Anderson & Citkowski, P.C.

(57) ABSTRACT

The present invention relates to a communication headset comprising an earpiece housing and a boom having at least two independent pivot points. The boom of the present invention includes a first end, a second end and a universal joint disposed between the first and second ends. The first end of the boom is pivotally attached to a portion of the earpiece housing such that the boom is rotatably adjustable in a plane parallel to a user's ear allowing a user to adjust the microphone disposed at the second end of the boom in a position relative to the user's mouth. The universal joint disposed between the first and second ends of the boom provides the user with a second pivot point such that the user can adjust the second end of the boom to at least one of a plurality of positions independent of the first end of the boom attached to the earpiece housing. The user is allowed to optimize the position of the microphone disposed at the second end of the boom by using only one hand allowing a user to use a second or free hand to perform some other desired or necessary activity.

19 Claims, 2 Drawing Sheets

COMMUNICATION HEADSET

RELATED APPLICATION

This application claims priority of U.S. Provisional Patent Application Ser. No. 60/328,547 filed Oct. 11, 2001, which is incorporated herein by reference.

FIELD OF THE INVENTION

The present invention relates to a communication headset for use with communication devices or systems. More particularly, the invention relates to a communication headset having a boom with a plurality of functional features including at least two independent pivot points.

BACKGROUND OF THE INVENTION

Communication headsets can be used as an accessory in a variety of communication applications such as wired and wireless telephone communications, aircraft communications, ship-to-shore communications, and various other communication systems.

Ergonomic considerations in the design of communication headsets include the comfort of the device, the ease of putting the headset on and subsequently adjusting it for use, the stability of retention, the restriction of user mobility resulting from the wearing of the headset, as well as the quality of the sound delivered by the device.

Many headset designs offer a bendable microphone boom to allow the user to optimally position the end of the boom adjacent his or her mouth. This type of adjustment usually requires two hands which will prevent the user from making a desired adjustment to the microphone and to the boom while performing an activity which requires the use of at least one hand such as driving an automobile.

The present invention provides a communication headset that may be worn comfortably and stably on one ear of the user while being easily adjustable with one hand.

SUMMARY OF THE INVENTION

The present invention relates to a monaural communication headset having a boom that is pivotally adjustable about at least two points along its body. The communication headset is designed such that a wearer may conveniently adjust the boom to a desired position using one hand with minimal effort.

The communication headset includes an earpiece housing having first and second interconnecting portions and an outer ear mounting member. The first portion of the earpiece housing has a plurality of acoustic apertures disposed therein to permit the free flow of sound waves being emitted from an earpiece disposed within an inner cavity defined by the interconnection of the first and second portions. The outer ear mounting member pivotally attaches to the earpiece housing at one end such that the mounting member is rotatable about the housing.

In the preferred embodiment, the boom of the present invention includes a first and second end and a universal joint disposed between these ends. The first end is pivotally attached to the second portion of the earpiece housing such that the boom is rotatably adjustable in a plane parallel to the user's ear. The second end of the boom is disposed with a microphone for the user to speak into when using the communication headset.

Most preferably, the boom will include a universal joint disposed between the first and second ends that allows the user to position the microphone end of the boom in at least one of a plurality of positions independent of pivoting the first end that is attached to the second portion of the earpiece housing.

The boom may also include additional features such as an on/off switch disposed adjacent the first end of the boom whereby the user can simply push a button to enable or disable the use of the communication headset. The boom may also be disposed with a volume control wheel adjacent the first end allowing a user to adjust the output level of the earphone.

The communication headset of the present invention allows a user to conveniently and optimally adjust the boom with one hand to a desired location for speaking into the microphone. Function switches may also be included that can be easily actuated or adjusted to obtain the optimal operating conditions of the communication headset even when performing a task which requires the use of at least one hand, such as driving.

BRIEF DESCRIPTION OF THE DRAWINGS

The present invention will be better understood by reference to the following detailed description in conjunction with the accompanying drawings in which the like reference characters refer to like parts throughout the several views and in which.

DETAILED DESCRIPTION OF THE INVENTION

Figure 1:
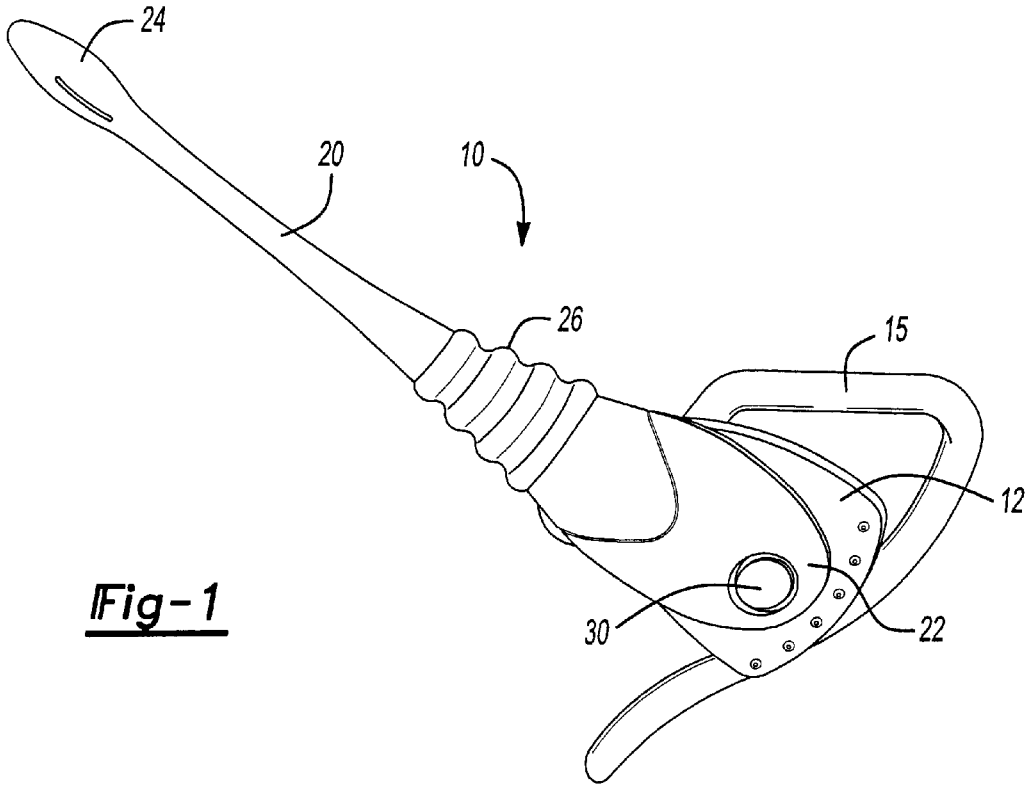
FIG. 1 is a perspective view of the communication headset according to the invention.

With reference to FIG. 1, the communication headset 10 includes an earpiece housing 12 and a boom 20. The earpiece housing 12 includes first 14 and second 16 interconnecting portions and an outer ear mounting member 15, such as an earhook, attached thereto. The interconnecting portions may be fastened together by conventional means such snap fitting, screws, adhesive materials and the like. See FIG. 2.

Figure 3:
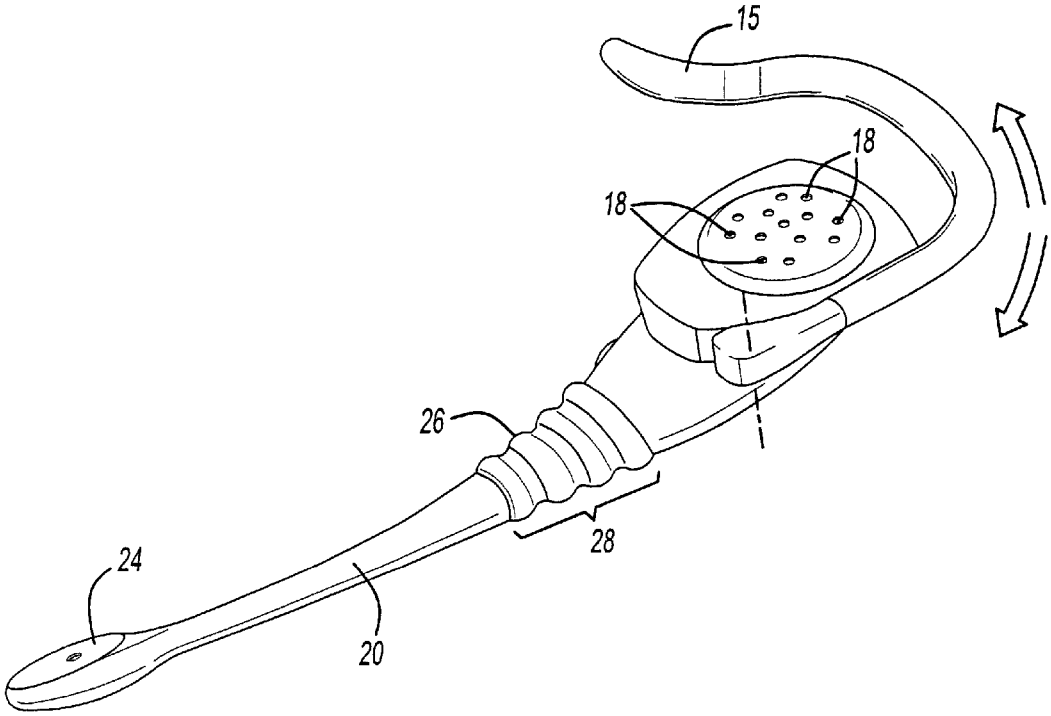
FIG. 3 is a perspective view of the communication headset illustrating the plurality of acoustic apertures disposed in the earpiece housing as according to the invention.

As best illustrated in FIG. 3, the first interconnecting portion 14 of the earpiece housing contains a plurality of acoustic apertures 18 that permit the free flow of sound waves being emitted from an earphone device or speaker disposed within an inner cavity defined by joining the first 14 and second 16 portions together. It is appreciated that any shape or number of apertures 18 may be utilized without limiting the scope of the invention.

Figure 2:
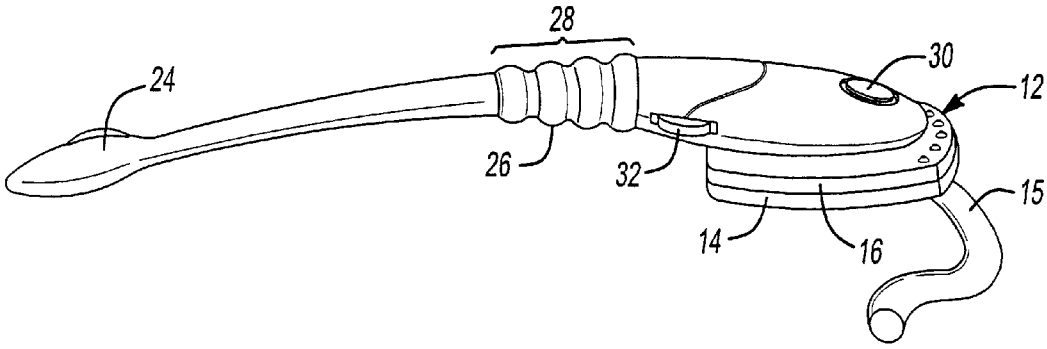
FIG. 2 is a perspective view of the communication headset that includes a volume control wheel and a push button on/off switch.

In the preferred embodiment, the boom 20 of the communication headset 10 includes a first end 22, a second end 24, and a universal joint 26 disposed between the first 22 and second 24 ends. As best illustrated in FIG. 2, the first end 22 of the boom 20 is pivotally attached to the second portion 16 of the earpiece housing 12 such that the boom 20 is rotatably adjustable in a plane parallel to a wearer's ear. The second end 24 of the boom 20 is disposed with a microphone for a user to speak into during use of the communication headset 10.

Most preferably, the boom 20 includes a universal joint 26 disposed between the first 22 and second 24 ends which is adapted to allow a user to position the second end 24 of the boom 20 in at least one of a plurality of positions independent of the first end 22. See FIG. 1.

As an option, the universal joint 26 of the boom 20 may include a boot cover to protect the joint 26 from dirt and dust contamination or the like. As illustrated in FIGS. 1, 2 and 3, the universal joint 26 is disposed adjacent the first end 22 of the boom 20 but other positions may be resorted without exceeding the scope of the invention.

The universal joint 26 provides a second pivot point separate and distinct from the pivot point at the first end 22 of the boom 20. By using one hand, the user of the communication headset 10 according to the present invention can adjust the second end 24 of the boom 20 that includes the microphone to one of a plurality of desired positions independent of pivoting the first end 22. This allows the user to achieve optimal comfort and utility of the communication headset 10.

Referring again to FIG. 1, the boom 20 of the present invention may include an on/off switch 30 disposed at the first end 22 of the boom 20 that would permit the user to enable or disable operation of the communication headset 10 conveniently with one hand. The switch 30 may be of the push button type, toggle switch, slide contact or the like.

Further, as best illustrated in FIG. 2, the boom 20 may include a volume control wheel 32 for adjusting the volume of the acoustics being emitted from the earphone contained within the earpiece housing 12. Here again, this volume control feature 32 can be easily adjusted by the use of one hand allowing the operator to perform some other activity with his free hand as desired or necessary. Additional features such as a mute, automatic redial, call-waiting or three-way switching may also be included in the headset for the user's convenience.

The communication headset preferably connects to a communication device or system via a electrical cable (not shown). The electrical cable connects to electronic circuitry of the earpiece disposed in the earpiece housing 12 at one end. The other end of the cable is disposed with an electrical connector for connecting to the communication equipment. Alternatively, the headset 10 may be designed to include a transceiver for wireless communication with the communication device/system to obviate the need for a cable. However, use of a cable would allow for the on/off 30 and volume control 32 switches to be integrated therein as opposed to having them integrated into the headset 10.

The earpiece housing 12 may be fitted with a cover (not shown) made from a cushion material, such as foam rubber or the like, to provide additional comfort to the wearer. Likewise, the earhook 15 may be made from or covered with a soft material such as rubber or plastic for the same purpose. The earhook 15 may also be formed from a flexible material such that the user can make adjustments thereto to achieve the desired fit about the ear for maximizing comfort and utility.

The alternative embodiment of the communication headset as according to the invention may be designed in a binaural fashion that includes the earpiece housing and boom as described above.

Having thus described the invention, many modifications thereto will become apparent to those skilled in the art to which it pertains without departing from the scope and spirit of the invention as defined in the appended claims.

I claim:

1. A communication headset for use with a communication device comprising:

an earpiece housing, said earpiece housing having first and second interconnecting portions and an outer ear mounting member attached thereto, said first portion having at least one acoustic aperture disposed therein, said earpiece housing having an earphone disposed therein; and a boom, said boom having a first end, a second end, and a universal joint disposed between said first and second end, said first end being pivotally attached to said second interconnecting portion of said earpiece housing such that said boom is rotatably adjustable in a plane parallel to a user's ear, said second end of said boom being disposed with a microphone, said universal joint adapted to allow the user to pivotally position said second end of said boom in at least one of a plurality of positions independent of pivoting said first end.

2. The communication headset of claim 1 wherein said boom further includes an on/off switch disposed at or adjacent said first end.

3. The communication headset of claim 1 wherein said boom further includes a volume control wheel at or adjacent said first end.

4. The communication headset of claim 1 wherein said boom includes a boot cover fitted about said universal joint.

5. The communication headset of claim 1 further including a wireless communication link for linking said headset to the communication device.

6. The communication headset of claim 1 further including an electrical cable for connecting said headset to the communication device.

7. The communication headset of claim 6 wherein said electrical cable further includes an on/off and a volume control switch.

8. A communication headset having an earpiece housing that includes at least one acoustic aperture through which sound waves travel, said earpiece housing having an earpiece disposed therein, said headset comprising:

a boom, said boom having a first end, said first end being pivotally attached to said earpiece housing such that said boom is rotatably adjustable in a plane parallel to a user's ear;

a second end, said second end of the boom being disposed with a microphone;

a universal joint disposed between said first and second end, said universal joint adapted to allow the user to position said second end of said boom in at least one of a plurality of positions independent of pivoting said first end; and at least one function switch disposed adjacent said first end.

9. The communication headset of claim 8 wherein the boom includes a boot cover fitted about said universal joint.

10. The communication headset of claim 8 wherein the earpiece further includes an outer ear mounting member.

11. The communication headset of claim 8 wherein said at least one function switch includes an on/off switch.

12. The communication headset of claim 11 wherein said at least one function switch further includes a volume control switch.

13. A communication headset having an earpiece housing, said earpiece housing having an earpiece disposed therein, said headset comprising:

a boom having first and second ends and a universal joint disposed between said first and second ends, said first end being pivotally attached to the earpiece such that said boom is movable in a plane parallel to a user's ear, said second end of said boom being disposed with a microphone, said universal joint operative to allow the user to position said second end of said boom in at least one of a plurality of positions independent of pivoting said first end.

14. A communication headset for use with a communication device comprising:

an earpiece housing, said earpiece housing having first and second interconnecting portions and an outer ear mounting member attached thereto, said first portion having at least one acoustic aperture disposed therein, said earpiece housing having an earphone disposed therein;

a boom, said boom having a first end, a second end, and a universal joint disposed between said first and second end, said first end being pivotally attached to said second interconnecting portion of said earpiece housing such that said boom is rotatably adjustable in a plane parallel to a user's ear, said second end of said boom being disposed with a microphone, said universal joint adapted to allow the user to pivotally position said second end of said boom in at least one of a plurality of positions independent of pivoting said first end; and a volume control disposed at or adjacent said first end of the boom.

15. A communication headset for use with a communication device comprising:

an earpiece housing, said earpiece housing having first and second interconnecting portions and an outer ear mounting member attached thereto, said first portion having at least one acoustic aperture disposed therein, said earpiece housing having an earphone disposed therein;

a boom, said boom having a first end, a second end, and a universal joint disposed between said first and second end, said first end being pivotally attached to said second interconnecting portion of said earpiece housing such that said boom is rotatably adjustable in a plane parallel to a user's ear, said second end of said boom being disposed with a microphone, said universal joint adapted to allow the user to pivotally position said second end of said boom in at least one of a plurality of positions independent of pivoting said first end; and an on/off switch disposed at or adjacent said first end of the boom.

16. The communication headset of claim 15 wherein said boom includes a boot cover fitted about said universal joint.

17. The communication headset of claim 15 further including a wireless communication link for linking said headset to the communication device.

18. The communication headset of claim 15 further including an electrical cable for connecting said headset to the communication device.

19. The communication headset of claim 18 wherein said electrical cable further includes an on/off and a volume control switch.

* * * * *